United States Patent [19]

Akagawa et al.

[11] Patent Number: 4,895,098

[45] Date of Patent: Jan. 23, 1990

[54] LUBRICANT APPLICATOR

[75] Inventors: Minoru Akagawa, Fremont, Calif.; Hisakazu Fukumoto, Tokyo, Japan; Michitane Kosaka; Masatoshi Suzuki, both of Chiba, Japan; Takashi Nakayama, Ibaragi, Japan

[73] Assignee: Intelmatec Corporation, Fremont, Calif.

[21] Appl. No.: 273,564

[22] Filed: Nov. 21, 1988

[30] Foreign Application Priority Data

Feb. 4, 1988 [JP] Japan ..... 63-13068[U]

[51] Int. Cl.[4] ..... B05C 11/08

[52] U.S. Cl. ..... 118/56; 118/106; 118/107; 118/121; 118/320; 427/355

[58] Field of Search ..... 118/58, 320, 106, 107, 118/121, 52, 56; 427/355, 240

[56] References Cited

U.S. PATENT DOCUMENTS

| | | | |
|---|---|---|---|
| 1,984,414 | 12/1934 | Lee | 118/320 X |
| 3,294,058 | 12/1966 | Shriro | 118/320 X |
| 3,436,259 | 4/1969 | Regh et al. | 427/355 X |
| 3,781,107 | 12/1973 | Ruhland | 118/106 X |
| 4,075,974 | 2/1978 | Plows et al. | 118/320 X |
| 4,425,866 | 1/1984 | Hoffmann | 118/107 X |
| 4,510,176 | 4/1985 | Cuthbert et al. | 427/240 X |
| 4,590,094 | 5/1986 | Ringer, Jr. | 118/56 X |
| 4,633,804 | 1/1987 | Arii | 118/52 |
| 4,668,334 | 5/1987 | Doornveld | 118/52 X |
| 4,790,262 | 12/1988 | Nakayama et al. | 118/320 X |

*Primary Examiner*—Richard L. Chiesa

*Attorney, Agent, or Firm*—Flehr, Hohbach, Test, Albritton & Herbert

[57] ABSTRACT

A lubricant applicator has a horizontally oriented spindle on which a disk to be processed is detachably attached and rotated with the spindle. After a lubricant is sprayed on both its surfaces from nozzles disposed adjacent thereto, the disk is brought between a pair of vertically stretched tapes while rotating with the spindle. A pair of grippers sandwiching the disk applies pressure on its surfaces through the tapes to uniformly control the lubricant film thickness on the disk surfaces.

3 Claims, 2 Drawing Sheets

LUBRICANT APPLICATOR

BACKGROUND OF THE INVENTION

This invention relates to a device for applying a lubricant onto a hard disk.

The so-called spin-coating method is mostly relied upon by prior art lubricant applicators for applying a lubricant onto surfaces of a disk. With an applicator of this type, the rotational speed of its spinner, temperature, the rate at which the lubricant is dropped, the dimensions of the overplate and the rate of a gas flow must be adjusted according to highly developed technologies, depending on many factors such as the composition of the lubricant and its viscosity. If any of required adjustments is not properly carried out, the resultant film of lubricant becomes defective.

SUMMARY OF THE INVENTION

It is therefore an object of the present invention to provide a lubricant applicator capable of efficiently and properly applying a lubricant onto disk surfaces. The above and other objects of the present invention are achieved by providing an improved lubricant applicator characterized as being comprised of a spindle rotatably supporting a disk to be lubricated, gas nozzles disposed adjacent to the disk surfaces for blowing dust particles off, lubricant nozzles similarly disposed adjacent to the disk surfaces for supplying a lubricant onto the disk surfaces, a pair of tapes sandwiching the disk therebetween and a device for applying pressure on the disk surfaces through these tapes.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
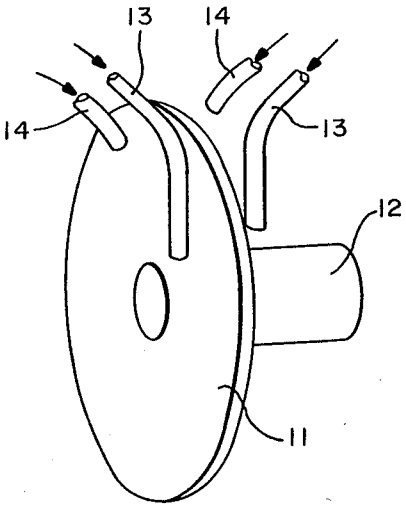
FIGS. 1 and 2 are schematic diagonal views of a lubricant applicator embodying the present invention to show positional and functional relationships of some of its components.
Figure 2:
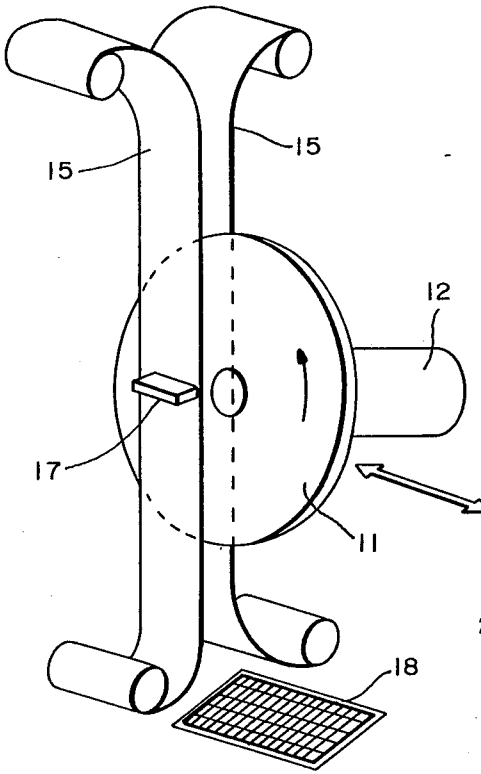

A lubricant applicator embodying the present invention is described below with reference to drawings. In FIGS. 1 and 2 which schematically show elements of this lubricant applicator separately for the purpose of clarity, numeral 11 indicates a disk to be processed, removably secured to the front end of a rotatably supported spindle 12 such that they can rotate together in coaxial relationship while the disk surfaces remain substantially vertical. The disk 11 is affixed to the spindle 12 by means of a chuck or the like (not shown) in a known manner. As shown in FIG. 1, a pair of gas nozzles 13 is disposed adjacent to the two surfaces of the disk 11 such that dust particles on the disk surfaces can be blown off by air or an inactive gas emitted therethrough. Similarly, a pair of lubricant nozzles 14 is disposed adjacent to the two surfaces of the disk 11 for coating the disk surfaces with a specified amount of a lubricant supplied therefrom. As shown in FIG. 2, furthermore, a pair of tapes 15 is stretched vertically so as to sandwich a portion of the disk 11 therebetween. A pair of wiping grippers 17 (only one on proximal side shown) is disposed near the disk surfaces and sandwiching the disk 11 therebetween. The ends of the grippers 17 facing inwardly toward each other are made of an elastic material such as rubber and are adapted to contact the disk surfaces through the tapes 15 to apply a pressure on the disk surfaces. The spindle 12 (and hence the disk 11) is adapted to rotate as shown by an arrow in FIG. 2 and is horizontally moved as shown by a double-headed arrow in FIG. 2. Thus, the disk surfaces coated with a lubricant supplied from the lubricant nozzles 14 are wiped uniformly by the tapes 15 which are made to contact them by the grippers 17. Numeral 18 indicates an exhaust opening for scattered lubricant drops. Alternatively, a cover may be provided for preventing lubricant drops from scattering.

Figure 4:
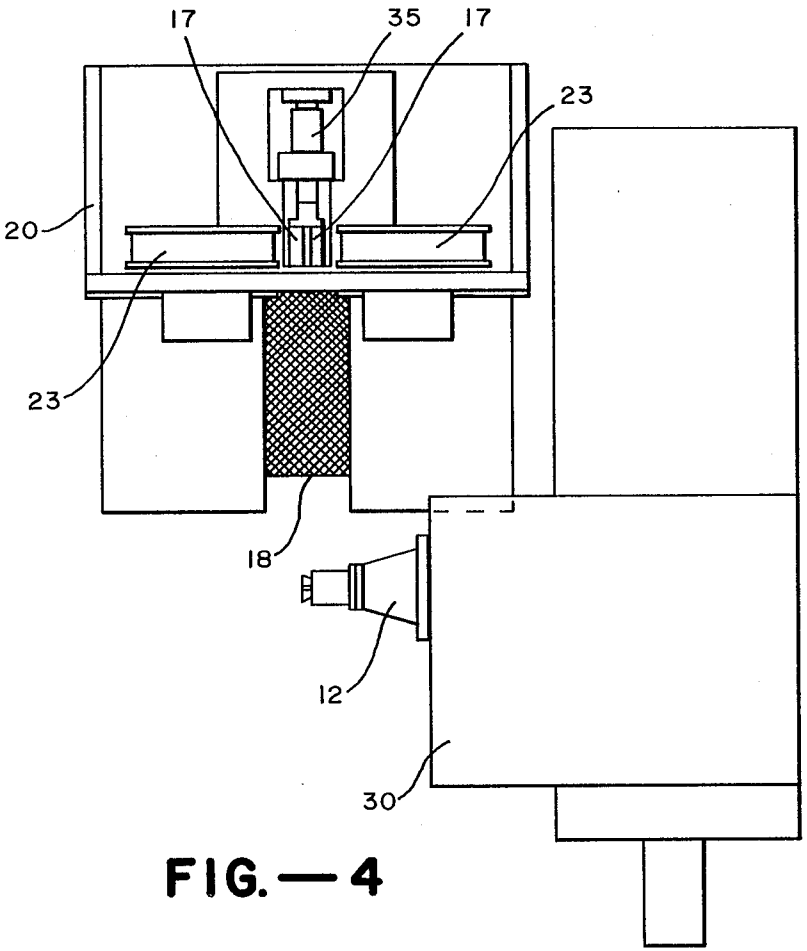
FIG. 4 is a plan view of the lubricant applicator of FIG. 3.
Figure 3:
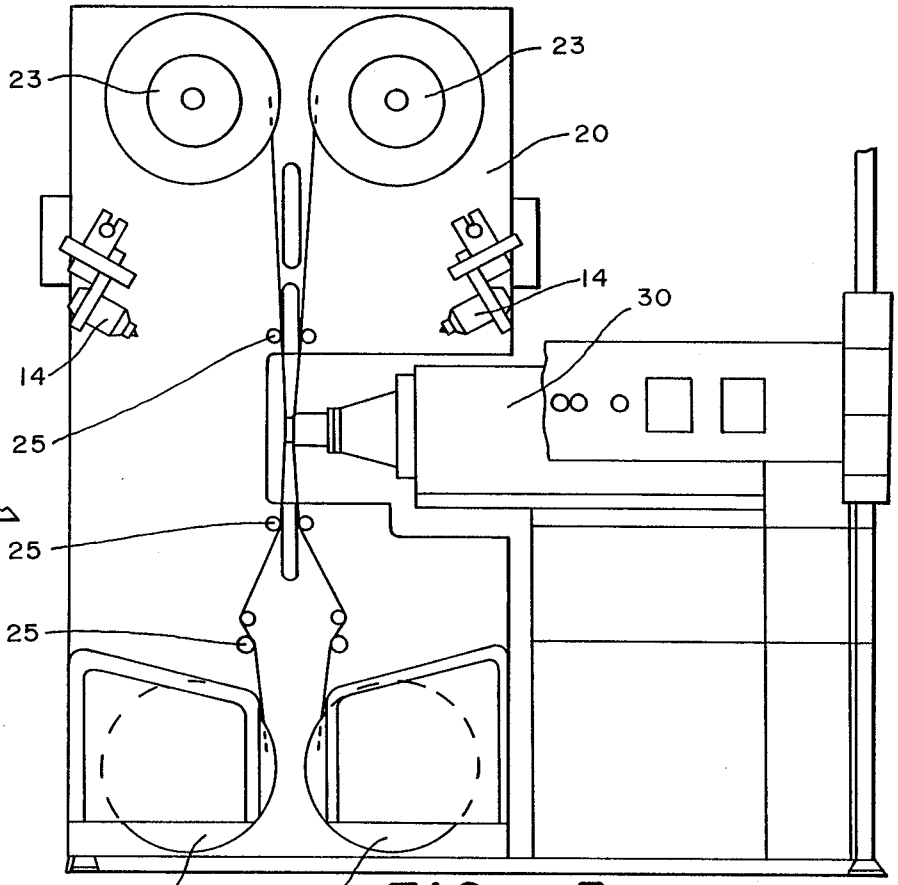
FIG. 3 is a front view of a lubricant applicator according to one embodiment of the present invention.

The basic components of a lubricant applicator embodying the present invention as well as their functions having been described above, FIGS. 3 and 4 are referenced next to describe an exemplary overall structure of a lubricator. Numeral 20 indicates a wiping unit assembly supporting not only the aforementioned gas nozzles 13 and lubricant nozzles 14 but also idler sleeves 23 and drive sleeves 24 around which the tapes 15 are wound and between which the tapes 15 are stretched. The tapes 15 are slowly unwound from the idler sleeves 23 and, guided by guiding rollers 25, are taken up by the drive sleeves 24 connected to a motor (not shown). Numeral 30 indicates a spindle assembly which is horizontally slidable with respect to the wiping unit assembly 20 and serves to rotatably support the aforementioned spindle 12 in a horizontal direction. Numeral 35 generally indicates adjusting means for controllable adjusting the pressure applied to the surfaces of the disk 11 by the grippers 17.

With a lubricant applicator thus structured, the spindle 12 is initially rotated slowly for dusting after a disk to be processed is loaded. After the disk surfaces are dusted and coated with a lubricant applied from the lubricant nozzles 14, the spindle 12 is rotated at a faster rate for spin-coating, scattering away the excess lubricant. Thereafter, the disk 11 supported by the spindle assembly 30 is inserted between the two tapes 15 and a pressure controllable adjusted by the adjusting means 35 is applied therethrough on the surfaces by the grippers 17. With this series of processes, the lubricant is applied smoothly, reliably and continuously on disk surfaces.

The foregoing description of a preferred embodiment of the invention has been presented for purposes of illustration and description. It is not intended to be exhaustive or to limit the invention to the precise form disclosed. Such modifications and variations that may be apparent to a person skilled in the art are intended to be included within the scope of this invention.

What is claimed is:

1. A lubricant applicator comprising a rotatable spindle to which a disk is detachable attached so as to rotate coaxially with said spindle, gas nozzles and lubricant nozzles disposed adjacent to surfaces of said disk, a pair of tapes sandwiching said disk therebetween, and gripping means for applying pressure through said tapes on said surfaces of said disk.

2. The lubricant applicator of claim 1 further comprising means for rotatably supporting said spindle in a horizontal direction and moving said spindle horizontally so as to be able to insert said disk between said tapes.

3. The lubricant applicator of claim 1 wherein each of said tapes is stretched between an idler sleeve and a drive sleeve and is adapted to move generally vertically from said idler sleeve to said drive sleeve.

* * * * *